US009484671B2

(12) United States Patent
Zhu et al.

(10) Patent No.: US 9,484,671 B2
(45) Date of Patent: Nov. 1, 2016

(54) ELECTRICAL CONNECTOR AND CONDUCTIVE TERMINAL ASSEMBLY THEREOF

(71) Applicant: Tyco Electronics (Shanghai) Co., Ltd., Shanghai (CN)

(72) Inventors: Xiaobo Zhu, Shanghai (CN); Liang Huang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/617,411

(22) Filed: Feb. 9, 2015

(65) Prior Publication Data

US 2015/0222056 A1 Aug. 6, 2015

Related U.S. Application Data

(63) Continuation of application No. PCT/IB2013/056437, filed on Aug. 6, 2013.

(30) Foreign Application Priority Data

Aug. 7, 2012 (CN) ..... 2012 1 0279536

(51) Int. Cl.

| | |
|---|---|
| ***H01R 13/64*** | (2006.01) |
| ***H01R 13/6461*** | (2011.01) |
| ***H01R 13/6474*** | (2011.01) |
| ***H01R 24/62*** | (2011.01) |
| *H01R 12/72* | (2011.01) |

(52) U.S. Cl.

CPC ..... *H01R 13/6461* (2013.01); *H01R 13/6474* (2013.01); *H01R 24/62* (2013.01); *H01R 12/724* (2013.01)

(58) Field of Classification Search

CPC ..... H01R 13/6461; H01R 13/6467; H01R 13/6471; H01R 13/6474; H01R 13/6463; H01R 13/6473; H01R 24/64

See application file for complete search history.

(56) References Cited

U.S. PATENT DOCUMENTS

| | | | | |
|---|---|---|---|---|
| 6,120,330 | A | 9/2000 | Gwiazdowski | |
| 7,431,616 | B2 * | 10/2008 | Minich | H01R 13/514 439/607.05 |
| 7,481,678 | B2 * | 1/2009 | Aekins | H01R 13/7033 439/620.11 |
| 7,485,010 | B2 * | 2/2009 | Aekins | H01R 13/41 439/620.13 |
| 7,572,148 | B1 * | 8/2009 | Pepe | H01R 13/514 439/607.05 |
| 7,601,034 | B1 * | 10/2009 | Aekins | H01R 13/6464 439/676 |

(Continued)

OTHER PUBLICATIONS

International Search Report and Written Opinion issued in co-pending application PCT/IB2013/056437, dated Dec. 13, 2013, 13 pages.

(Continued)

*Primary Examiner* — Ross Gushi
(74) *Attorney, Agent, or Firm* — Barley Snyder

(57) ABSTRACT

A conductive terminal assembly of an electrical connector is disclosed having a terminal aligning plate and four pairs of differential signal terminals. The terminal aligning plate made of a dielectric material. The four pairs of differential signal terminals are arranged in two columns in an array on the terminal aligning plate. Each terminal has a terminating end, a contacting end, and a terminal body. The terminal body extends between the terminating end and the contacting end. The terminal bodies of two first terminals in the same column, which are longitudinally adjacent to each other and have opposite polarities, are offset transversely.

5 Claims, 11 Drawing Sheets

(56) References Cited

U.S. PATENT DOCUMENTS 7,628,656 B2 * 12/2009 Shields ..... H01R 13/6469 439/676
7,658,648 B2 * 2/2010 Aekins ..... H01R 13/7033 439/620.11
7,682,203 B1 * 3/2010 Pharney ..... H01R 13/6658 439/676
7,708,603 B1 * 5/2010 Little ..... H01R 13/6464 439/676
7,824,197 B1 * 11/2010 Westman ..... H01R 13/6586 439/108
7,967,614 B1 * 6/2011 Cina ..... H01R 13/6469 439/76.1
7,976,349 B2 * 7/2011 Heckmann ..... A61F 2/4081 439/676
7,985,101 B2 * 7/2011 Fitzpatrick ..... H01R 13/64 439/676
8,002,571 B2 * 8/2011 Hogue ..... H01R 24/64 439/404
8,002,590 B2 * 8/2011 Ciezak ..... H01R 24/64 439/676
8,007,311 B2 * 8/2011 Hogue ..... H01R 4/2425 439/404
8,038,461 B2 * 10/2011 Hsu ..... H01R 4/023 439/344
8,047,875 B2 * 11/2011 Yamakami ..... H01R 13/6315 439/108
8,070,529 B2 * 12/2011 Xiong ..... H01R 12/725 439/620.15
8,075,347 B2 * 12/2011 Hogue ..... H01R 4/2425 439/676
8,133,069 B2 * 3/2012 Hogue ..... H01R 13/6464 439/404
8,157,600 B2 * 4/2012 Ciezak ..... H01R 24/64 439/676
8,202,118 B2 * 6/2012 Cohen ..... H05K 1/14 439/607.1
8,202,129 B2 * 6/2012 Lin ..... H01R 13/15 439/676
8,226,441 B2 * 7/2012 Regnier ..... H01R 9/038 439/626
8,272,888 B2 * 9/2012 Hogue ..... H01R 4/2425 439/404
8,313,338 B2 * 11/2012 Hogue ..... H01R 9/031 439/404
8,353,723 B2 * 1/2013 Heckmann ..... A61F 2/4081 439/620.11
8,425,255 B2 * 4/2013 Erickson ..... H01R 13/6464 439/620.22
8,465,302 B2 * 6/2013 Regnier ..... H01R 9/038 439/108
8,568,176 B2 * 10/2013 Huang ..... H01R 13/33 439/676
8,650,750 B2 * 2/2014 Engels ..... H01R 13/6585 29/857
8,747,158 B2 * 6/2014 Szczesny ..... H01R 4/04 439/607.07
8,764,483 B2 * 7/2014 Ellison ..... H01R 12/724 439/607.07
8,784,116 B2 * 7/2014 Buck ..... H01R 12/585 439/55
8,801,473 B2 * 8/2014 Fransen ..... H01R 13/6467 439/676
8,870,600 B2 * 10/2014 Wu ..... H01R 13/05 439/637
8,926,377 B2 * 1/2015 Kirk ..... H01R 12/724 439/701
9,083,096 B2 * 7/2015 Tobey ..... H01R 13/17
9,112,309 B1 * 8/2015 Chen ..... H01R 13/6467
9,118,134 B2 * 8/2015 Babu ..... H01R 13/26
9,136,649 B2 * 9/2015 Shih ..... H01R 13/658
9,160,123 B1 * 10/2015 Pao ..... H01R 12/716
9,203,195 B2 * 12/2015 Mueller ..... H01R 13/516
2003/0186591 A1 * 10/2003 Jensen ..... H01R 13/6474 439/676
2005/0272315 A1 * 12/2005 Hatterscheid ..... H01R 13/6467 439/676
2006/0019517 A1 * 1/2006 Raistrick ..... H01R 13/26 439/108
2006/0121793 A1 * 6/2006 Pharney ..... H01R 13/6658 439/676
2008/0003877 A1 * 1/2008 Siev ..... H01R 4/2429 439/607.01
2008/0248693 A1 * 10/2008 Winings ..... H01R 13/6471 439/607.05
2008/0254685 A1 * 10/2008 Murr ..... H01R 13/6474 439/676
2010/0130069 A1 * 5/2010 Fyne ..... H01R 13/6471 439/676
2010/0210132 A1 * 8/2010 Hogue ..... H01R 9/031 439/404
2012/0225585 A1 * 9/2012 Lee ..... H01R 13/6474 439/626
2014/0273633 A1 * 9/2014 Gatnau Navarro .. H01R 13/665 439/620.01
2014/0273634 A1 * 9/2014 Bopp ..... H01R 13/6466 439/620.09
2014/0273638 A1 * 9/2014 Valenti ..... H01R 13/6466 439/620.22
2014/0310957 A1 * 10/2014 Buck ..... H01R 12/585 29/882
2015/0222056 A1 * 8/2015 Zhu ..... H01R 24/62 439/607.01
2015/0223321 A1 * 8/2015 Ling ..... H01R 13/6471 174/36
2015/0280375 A1 * 10/2015 Xu ..... H01R 24/62 439/607.01

OTHER PUBLICATIONS

PCT International Preliminary Report on Patentability and Written Opinion of the International Searching Authority, International Application No. PCT/IB2013/056437, dated Feb. 10, 2015, 9 pages.

* cited by examiner

ELECTRICAL CONNECTOR AND CONDUCTIVE TERMINAL ASSEMBLY THEREOF

CROSS-REFERENCE TO RELATED APPLICATION

This application is a continuation of PCT International Application No. PCT/IB2013/056437 filed Aug. 6, 2013, which claims priority under 35 U.S.C. §119 to Chinese Patent application No. 201210279536.2, filed Aug. 7, 2012.

FIELD OF THE INVENTION

The invention is generally related to a high-speed electrical connector, and more specifically, to a low-crosstalk high-speed electrical connector having conductive terminal assembly with electrical compensation.

BACKGROUND

The field of high-speed data transmission imposes higher and higher requirements for electrical performance of an electrical connector. The electrical connector must reliably transmit data signal and ensure signal integrity, and as the size of the electrical connector increasingly becomes more compact, a plurality of terminals positioned in the electrical connectors are increasingly arranged at a higher densities. Since the space between signal terminals gets smaller, signal interference ("crosstalk") will occur between signal terminal pairs, particularly between adjacent differential signal terminal pairs. Such signal interference negatively affects the signal integrity of the whole signal transmission system.

In FIG. 1, a conventional electrical connector is shown where a signal is first transmitted through a first terminal 100' to an internal PCB 200', and the signal, after being optimized and compensated by a circuit on the PCB 200', is transmitted to a client PCB (not shown) via a second terminal 300'.

During the process of transmitting the signal, many signal transmission converting steps are performed, all of which cumulatively have a negative effect on signal integrity, such as insertion loss, loop loss, near-end crosstalk and the like. Additionally, since the conventional electrical connector integrates two PCBs through which the signal is compensated, the conventional electrical connector is complicated in structure, large is size, and has high manufacturing costs.

There is a need to a high speed electrical connector that reliably transmits data signal with high signal integrity, but has a small form factor, and of which can be economically produced.

SUMMARY

A conductive terminal assembly of an electrical connector has a terminal aligning plate and four pairs of differential signal terminals. The terminal aligning plate made of a dielectric material. The four pairs of differential signal terminals are arranged in two columns in an array on the terminal aligning plate. Each terminal has a terminating end, a contacting end, and a terminal body. The terminal body extends between the terminating end and the contacting end. The terminal bodies of two first terminals in the same column, which are longitudinally adjacent to each other and have opposite polarities, are offset transversely.

BRIEF DESCRIPTION OF DRAWINGS

The invention will now be described by way of example, with reference to the accompanying Figures, of which.

DETAILED DESCRIPTION OF THE PREFERRED EMBODIMENTS

According to requirements, specific embodiments of the present invention will be revealed herein. However, those of ordinary skill in the art would appreciate that the embodiments revealed herein are only exemplary examples and the present invention may take various forms. Hence, specific details revealed herein are not regarded as limiting the present invention, but only regarded as a basis of claims and a basis for teaching those skilled in the art to apply the present invention differently in any appropriate mode, including employment of various features disclosed and combination of features that might not be explicitly disclosed.

The term "alignment area" used in this invention means an area where the terminal bodies or the terminating ends of two terminals face each other in longitudinal direction.

Figure 1:
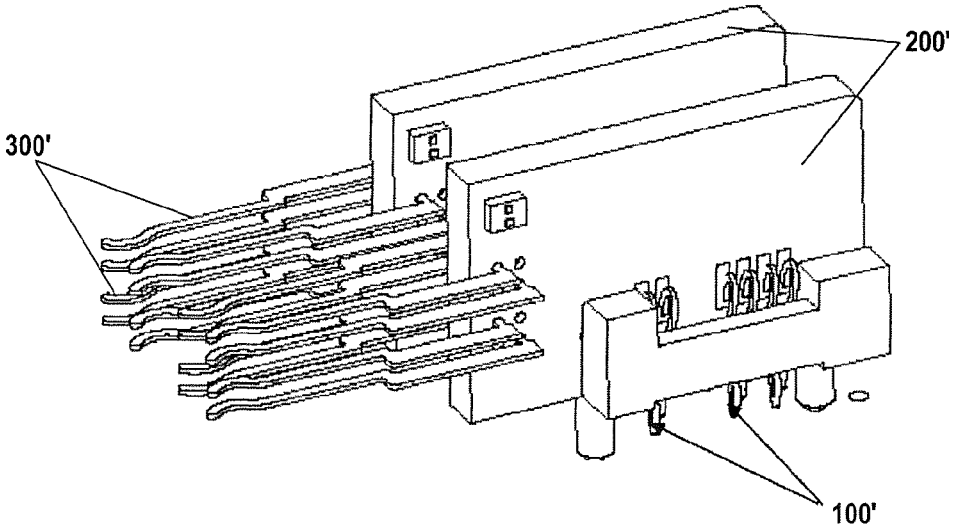
FIG. 1 is a perspective view of a conventional electrical connector.
Figure 2:
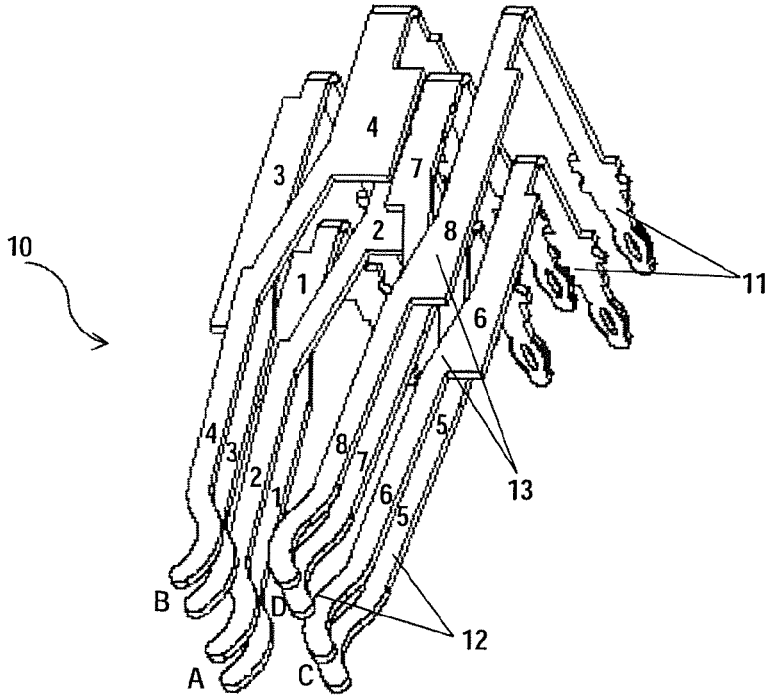
FIG. 2 is a perspective view of a conductive terminal assembly having a terminal aligning plate removed.
Figure 3:
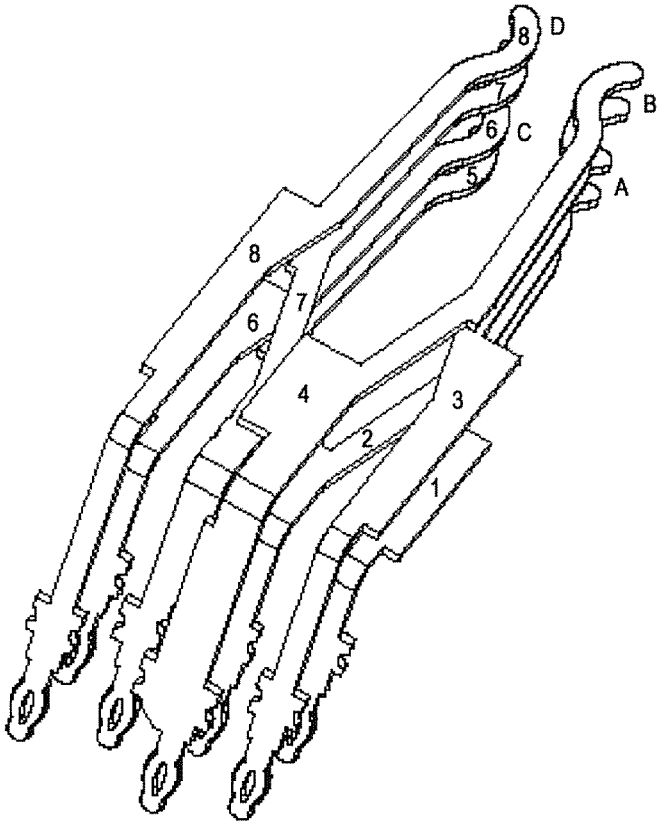
FIG. 3 is a perspective view of the conductive terminal assembly shown in FIG. 2.
Figure 4:
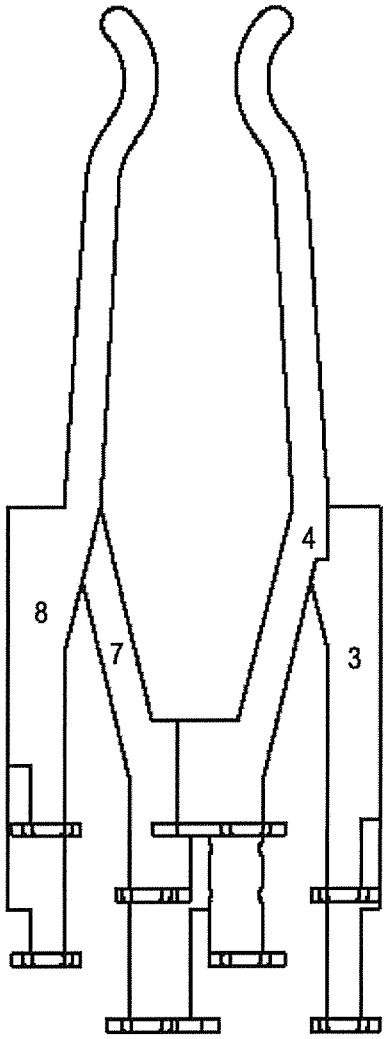
FIG. 4 is a top view of the conductive terminal assembly of FIG. 2.
Figure 5:
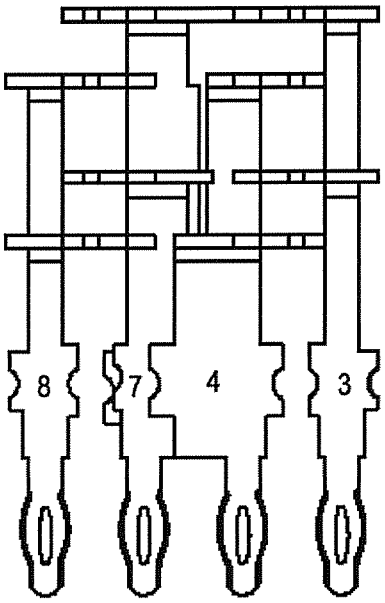
FIG. 5 is a side view of the conductive terminal assembly of FIG. 2.
Figure 6:
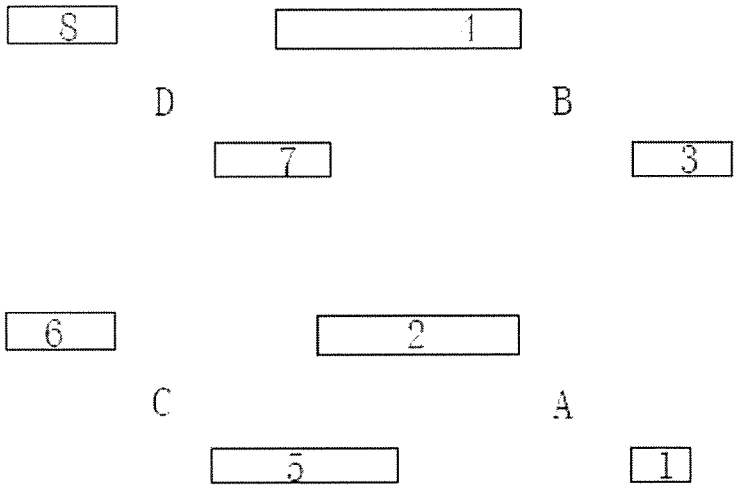
FIG. 6 is a sectional view of a terminal body of the conductive terminal assembly of FIG. 2 in a horizontal direction.
Figure 7:
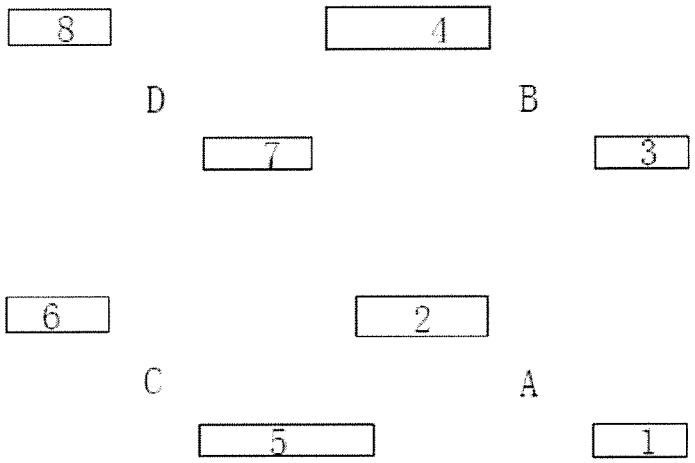
FIG. 7 is a sectional view of a terminating end of the conductive terminal assembly of FIG. 2 in a vertical direction.

In an embodiment of FIG. 2, a conductive terminal assembly 10 has had a terminal aligning plate 9 has been removed to clearly show the structure and arrangement of the conductive terminals. The conductive terminal assembly 10 includes four differential signal terminal pairs A-D, including eight terminals 1-8 in total. Each terminal 1-8 includes a terminating end 11 for contacting and connecting each terminal 1-8 to a circuit board, a contacting end 12 for mating with a complimentary mating connector (not shown), and a terminal body 13 extending between the terminating end 11 and the contacting end 12. The four differential signal terminal pairs A-D are arranged in an array on a terminal aligning plate 9 (see FIG. 8). The terminal aligning plate 9 is made of a dielectric material and used to hold and align the differential signal terminals 1-8 thereon. In an embodiment, the contacting end 12 is connected to the circuit board by soldering, although other connecting mechanisms known to those of ordinary skill in the art would also apply.

In the embodiments of FIGS. 2-7, the terminal assembly 10 includes a terminal array having two columns in total, a first column including differential signal terminal pairs A and B, and a second column including differential signal terminal pairs C and D, wherein the differential signal terminal pairs A and C are positioned together in row and differential signal terminal pairs B and D are positioned together in the same row. Since crosstalk is primarily introduced via a structure on a plug side and the shape of the terminals on the plug side cannot be modified, only terminals on a Jack side can be modified to enhance signal-end coupling for purposes of electrical compensation. In an embodiment, terminal enhancing single-end coupling is achieved by increasing the alignment area, such that: terminals 1 and 3, terminals 2 and 4, terminals 5 and 7, terminals 6-8; terminals 2 and 5, terminals 4 and 7; terminals 2 and 7, wherein terminals 1 and 3, terminals 6 and 8, terminals 2 and 5, terminals 4 and 7 and terminals 2 and 7. The alignment area is increased by widening the terminal bodies 13 of these terminals in the horizontal direction respectively, whereas terminals 2 and 4 and 5 and 7 achieve an increase of the alignment area by widening the terminal bodies 13 of these terminals in the horizontal direction, and by widening the terminating ends 11 of these terminals in the vertical direction, respectively.

In an embodiment, to reduce undesired single-end coupling, terminal bodies 13 of terminals 2 and 3 in the same column, which are longitudinally adjacent to each other and have opposite polarities, are offset transversely to eliminate the alignment area and thereby to reduce the single-end coupling so that electrical "balance" of the differential signal terminal pairs A and B can be improved. Similarly, terminal bodies 13 of terminals 6 and 7 in the same column, which are longitudinally adjacent to each other and have opposite polarities, are offset transversely to eliminate the alignment area and thereby to reduce the single-end coupling so that electrical "balance" of the differential signal terminal pairs C and D can be improved.

Examples of near-end crosstalk between the differential signal terminal pair A and differential signal terminal pair B in the same column, near-end crosstalk between the differential signal terminal pair A and differential signal terminal pair C in the same line, and near-end crosstalk between the differential signal terminal pair A and the differential signal terminal pair D in diagonal direction will now be discussed.

First, the near-end crosstalk (NEXT for short) between the differential signal terminal pair A and the differential signal terminal pair B is discussed as an example, NEXT_AB=1→3+2→4−2→3−1→4. The desired single-end coupling is enhanced and undesired single-end coupling is weakened by widening the horizontal terminal bodies of the terminals 1, 3 and by simultaneously widening the horizontal terminal bodies and vertical terminating ends of the terminals 2, 4 and by offsetting the terminals 2 and 3 transversely. By transversely offsetting the terminals 2, 3, the alignment area thereof is eliminated and the single-end crosstalk of 2→3 is decreased. By widening terminals 1, 3 in the horizontal direction and widening terminals 2, 4 both in the horizontal and vertical directions, the sum of the single-end crosstalk of 1→3 and the single-end crosstalk of 2→4 is increased. As a result, crosstalk between the differential signal terminal pairs A and B is reduced.

By widening terminals 2, 4 both in the horizontal and vertical directions, the limited space available is efficiently used, and the terminals 2 and 4 located inside of the column are prevented from occupying excessive in the horizontal direction.

Next, the near-end crosstalk between the differential signal terminal pair A and the differential signal terminal pair C is discussed as an example, NEXT_AC =1→5+2→6−2→5−1→6. Since edge-to-edge coupling is performed between terminals 1→5 and terminals 2→6, the single-end crosstalk is relatively small. Since terminals 1 and 6 are positioned at a relatively large distance from each other, the single-end cross talk between terminals 1→6 is very small and not sufficient to offset a sum of the single-end crosstalk between terminals 1→5 and the single-end crosstalk between terminals 2→6. Furthermore, the coupling between terminals 1→6 cannot be effectively increased because the two terminals are spaced the large distance apart, and the alignment area cannot be increased. Therefore, in order to reduce NEXT_AC, the single-end coupling between terminals 2→5 needs to be increased appropriately to offset the sum of the single-end crosstalk between terminals 1→5 and the single-end crosstalk between terminals 2→6. By increasing the alignment area of the terminals 2 and 5, the single-end crosstalk of terminals 2 and 5 is enhanced.

When the differential signal terminal pairs in the column direction are improved in the manner described above, where the crosstalk between the differential signal terminal pairs in the column direction is critical, the terminal 2 has been widened so that the coupling between the terminals 2 and 5 is too large for the terminal pairs A and C. Therefore, in between terminal pairs A and C, the alignment area between terminals 2 and 5 need to be reduced to achieve a reduction in the single-end coupling between terminals 2→5, so that the edge-to-edge coupling between terminals 1→5 and between terminals 2→6 suffices to offset the single-end coupling between terminals 2→5. However, the alignment area between terminals 2 and 5 cannot be reduced infinitely, otherwise the crosstalk between terminals 2→5 would become too small to balance the near-end crosstalk between the differential signal terminal pair A and differential signal terminal pair C.

Conventionally the terminal 2 from the differential signal terminal pair A and the terminal 5 from the differential signal terminal pair C would not have an alignment area. However, in an embodiment, in order to balance the edge-to-edge coupling between terminals 1, 5 and between terminals 2, 6, the terminals 2 and 5 generally have the alignment area and produce the single-end coupling so as to counteract the above edge-to-edge coupling. In situations where the crosstalk between the differential signal terminal pairs in the column direction is critical, as discussed above, the terminals 2 and 4, 5 and 7 have horizontal terminal bodies 13 and vertical terminating ends 11 that are widened. Therefore, generally to achieve electrical balance between differential signal terminal pairs A and C in the transverse line, the alignment area of terminals 2 and 5 is maintained at a reasonable level: if the widening in the horizontal and vertical directions is too large, the horizontal widening of terminals 2 and 5 needs to be reduced appropriately; if the widening in the horizontal and vertical directions makes the alignment area of terminals 2 and 5 insufficient, the widening needs to be increased appropriately.

Likewise, the above applies to the situation between terminal pairs B and D (NEXT_BD=3→7+4→8−3→8−4→7). The alignment area of the terminals 4-7 needs to be increased in order to increase the single-end crosstalk of terminals 4 and 7.

The near-end crosstalk between the differential signal terminal pair A and the differential signal terminal pair D in the diagonal direction is discussed as an example: NEXT_AD=1→7+2→8−2→7−1→8. Since terminals 1 and 7 and terminals 2 and 8 are positioned apart at a relatively far distance from each other, the single-end crosstalk of 1→7 and 2→8 is relatively small. Further, the terminals 1 and 8 are spaced too far apart from each other, so the single-end crosstalk of 1→8 is also very small. To achieve balance between near-end crosstalk of terminal pairs B and C, there is a need to enhance the single-end crosstalk between the terminals 2 and 7, and therefore there is a need to allow for a certain alignment area between the terminals 2 and 7 to adequately offset the sum of the single-end crosstalk between the terminals 1, 7 and the single-end crosstalk between the terminals 2, 8.

Since the near-end crosstalk between the differential signal terminal pairs B, C is very small, no discussion has been provided.

To maintain the electrical balance on the above-mentioned columns, namely, terminal pairs A and B, and terminal pairs C and D, the terminals 2 and 7 are widened in both the horizontal direction and the vertical direction. Specifically, terminal 2 is widened to increase the coupling with the terminal 4, and terminal 7 is widened to increase the coupling with the terminal 5. As such crosstalk is reduced between terminal pairs A and B and crosstalk between terminal pairs C and D. If widening of the terminals 2 and 7 on the diagonal line in both directions, for the sake of electrical balance of terminal pairs in the columns, causes the alignment area thereof to become too large, the crosstalk between the differential terminal pairs A and D on the diagonal line becomes unbalanced, and correspondingly the alignment area between the terminals 2 and 7 needs to be reduced. Thereby crosstalk between 2→7 would need to be reduced. However, the alignment area between the terminals 2 and 7 cannot be reduced infinitely; otherwise crosstalk between 2→7 becomes too small and insufficient to counteract the single-end crosstalk between terminals 1→7 and 2→8.

As described above, reduction of differential crosstalk can be achieved by appropriately balancing the single-end crosstalk according to the above calculation formula of differential crosstalk in combination with a definition and geometrical structure of the terminal. While the undesired single-end crosstalk is reduced by offsetting some terminals (reducing the alignment area), and on the other hand, the desired single-end crosstalk is increased by widening the terminal bodies and terminating ends of the terminals to increase the alignment area). The purpose of widening some terminals, for example, terminals 2 and 4 and terminals 5 and 7, in both the horizontal direction and the vertical direction, namely, widening both the terminal bodies as well as the terminating ends, is to address the need for the assembly 10 to occupy a compact space. In an embodiment, if the desired space is limited, widening may be performed solely in the horizontal direction.

In the above described embodiments, integration of the PCB is has been eliminated and a conductive terminal assembly 10 is disclosed having the client-desired electrical performance in a smaller volume. Furthermore, the above described embodiments are low in manufacturing costs, having a relatively simple structure, and may substantially improve production efficiency and reduce an unqualified product rate. Additionally, the conductive terminal assembly 10 is smaller and more space-saving than conventional designs.

Figure 8:
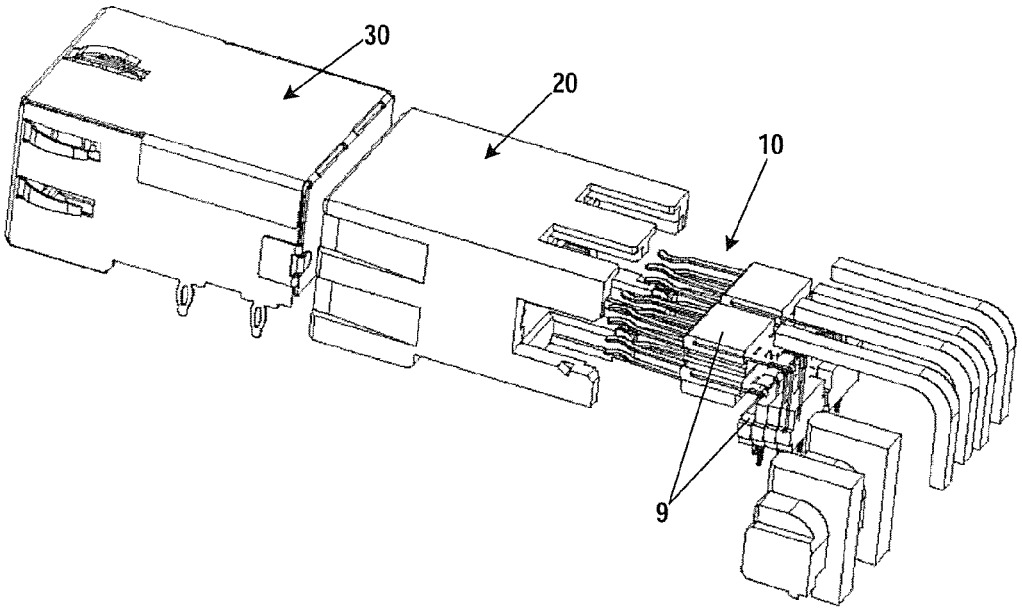
FIG. 8 is an exploded view of an electrical connector.
Figure 9:
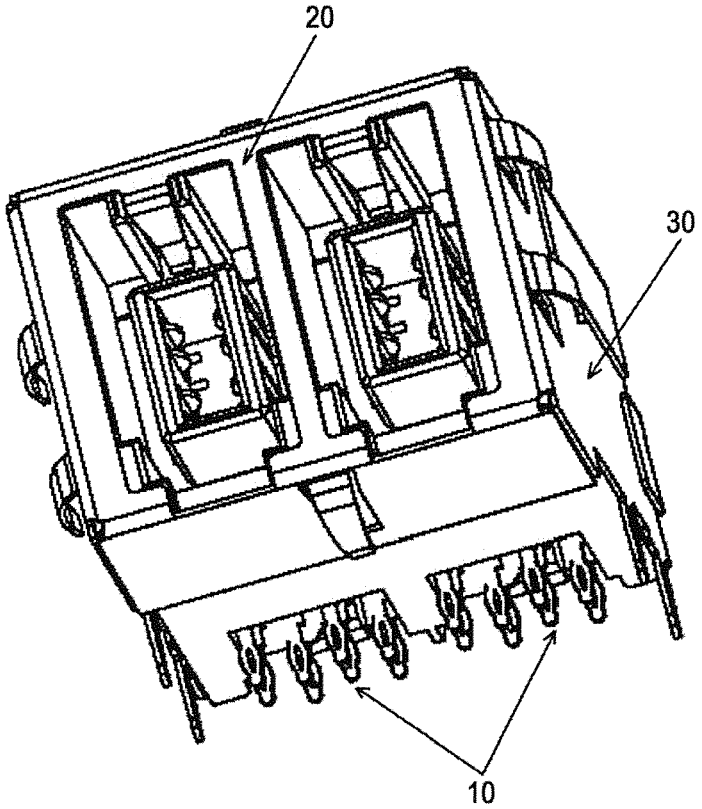
FIG. 9 is a perspective view of the electrical connector of FIG. 8 with two groups of conductive terminal assemblies as shown in FIG. 2.

In the embodiments of FIGS. 8-9, an electrical connector has a shielding housing 30, an insulating body 20 and two conductive terminal assemblies 10 positioned in the insulating body 20.

Figure 10A:
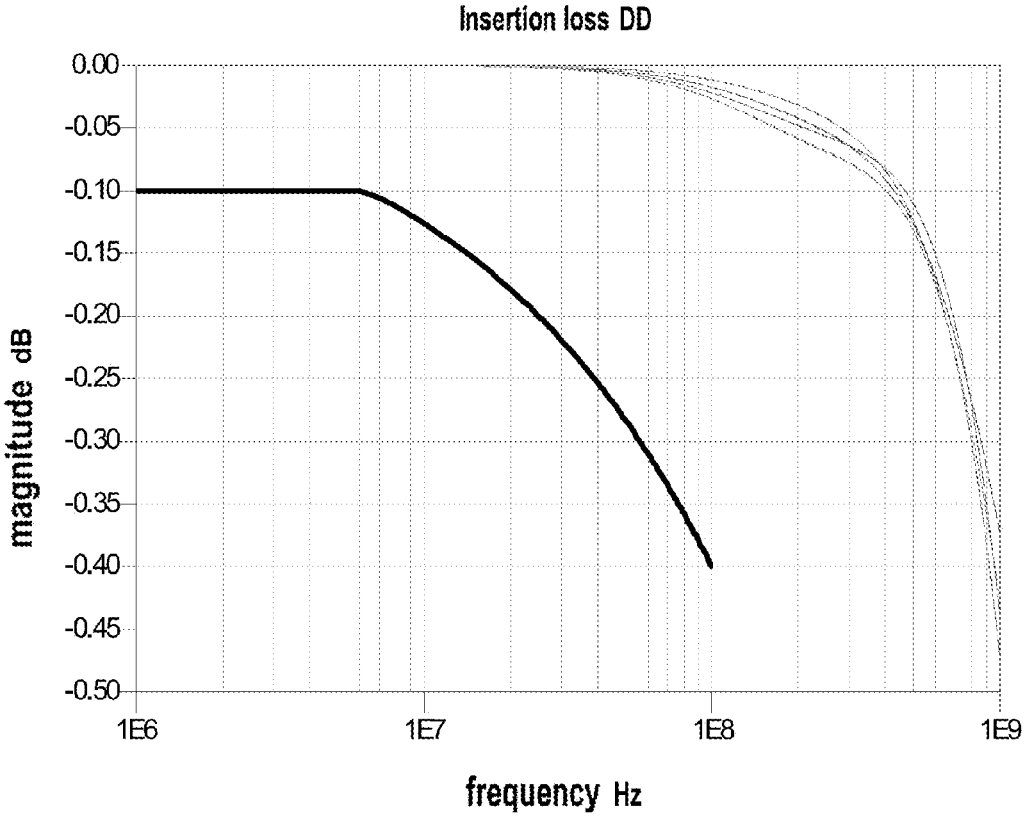
FIG. 10A is a graph showing simulated electrical connector insertion loss for the electrical connector shown in FIGS. 8-9.

FIG. 10A is a graph showing electrical connector insertion loss obtained through simulation, wherein a thick solid line in the left lower side represents insertion loss of a TIA-568-C.2 Cat 5e connector, and lines in the right upper side represent electrical connector insertion loss obtained by simulating the electrical connector having the conductive terminal assemblies 10. The insertion loss of the electrical connector is far lower than insertion loss value of the TIA-568-C.2 Cat 5e Standard.

Figure 10B:
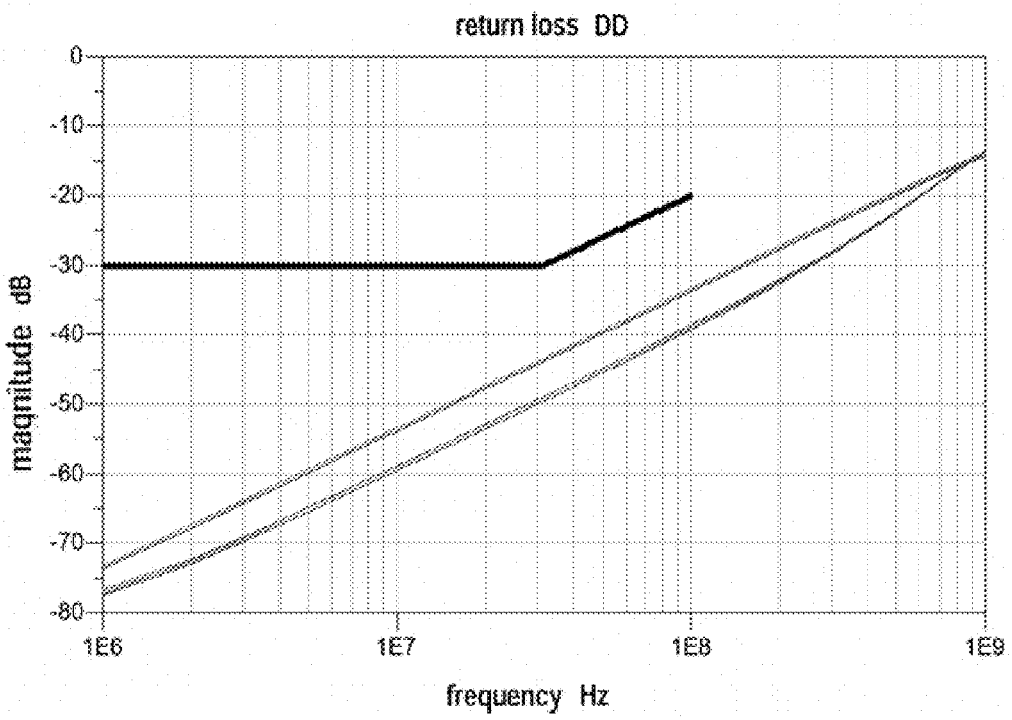
FIG. 10B is a graph showing simulated electrical connector echo loss for the electrical connector shown in FIGS. 8-9.

FIG. 10B is a graph showing electrical connector echo loss obtained through simulation, wherein the uppermost thick solid line represents echo loss of the TIA-568-C.2 Cat 5e connector, and the several lines below the thick solid line represent electrical connector echo loss obtained by simulating the electrical connector having the conductive terminal assemblies 10. The echo loss of the electrical connector is far lower than an echo loss value of the TIA-568-C.2 Cat 5e Standard.

Figure 10C:
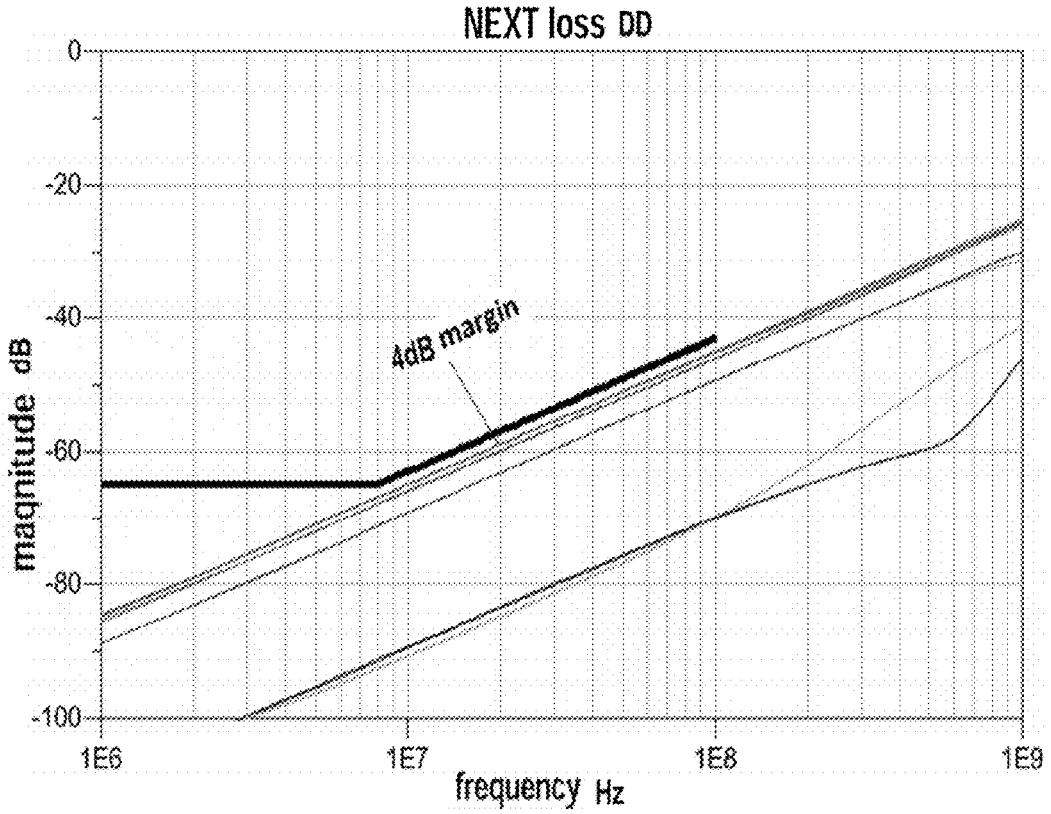
FIG. 10C is a graph showing simulated electrical connector near-end crosstalk for the electrical connector shown in FIGS. 8-9.

FIG. 10C is a graph showing electrical connector near-end crosstalk obtained through simulation, wherein the uppermost thick solid line represents the near-end crosstalk of the TIA-568-C.2 Cat 5e connector, and several lines below the thick solid line represent electrical connector near-end crosstalk obtained by simulating the electrical connector having the conductive terminal assemblies 10. The near-end crosstalk of the electrical connector is far lower than a near-end crosstalk value of the TIA-568-C.2 Cat 5e Standard, with 4 dB margin.

Figure 10D:
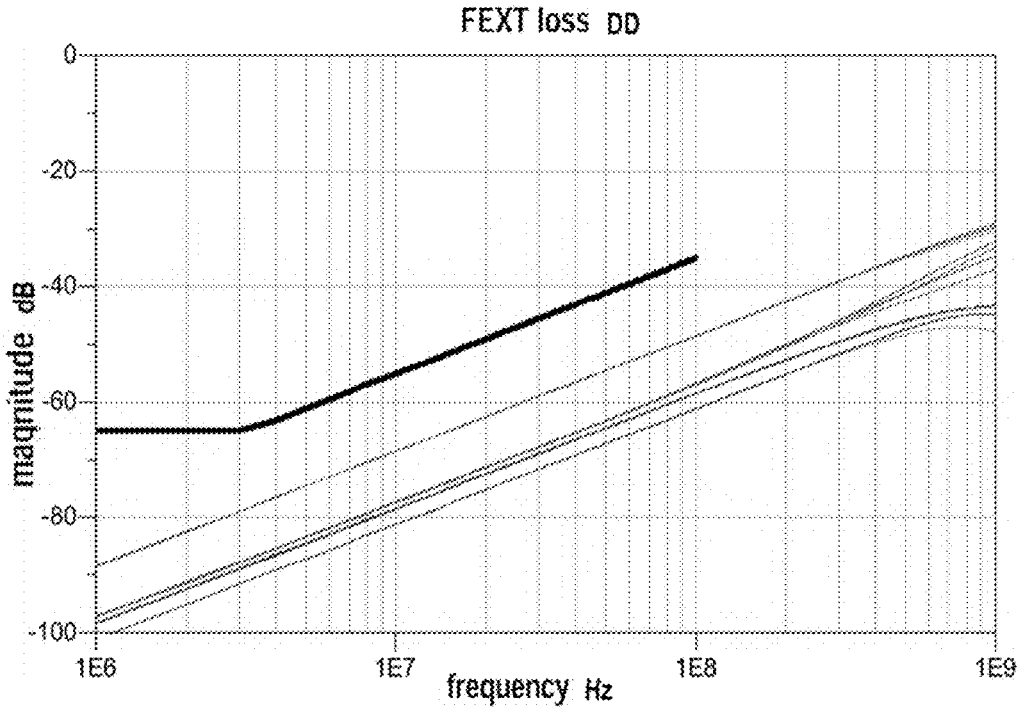
FIG. 10D is a graph showing simulated electrical connector far-end crosstalk for the electrical connector shown in FIGS. 8 to 9.

FIG. 10D is a graph showing electrical connector far-end crosstalk obtained through simulation, wherein the uppermost thick solid line represents the far-end crosstalk of the TIA-568-C.2 Cat 5e connector, and several lines below the thick solid line represent connector far-end crosstalk obtained by simulating the electrical connector having the conductive terminal assemblies 10. The far-end crosstalk of the electrical connector is far lower than a far-end crosstalk value of the TIA-568-C.2 Cat 5e Standard.

Consequently, from FIGS. 10A-10D, one of ordinary skill in the art would appreciate that the electrical connector having the conductive terminal assemblies 10 meets the requirements regarding CAT 5e in US Telecommunications Industry Association standard (Balanced Twisted-Pair Telecommunications Cabling and Components Standards, with serial number TIA-568-C.2), and has a sufficient margin of 4 dB.

Figure 11:
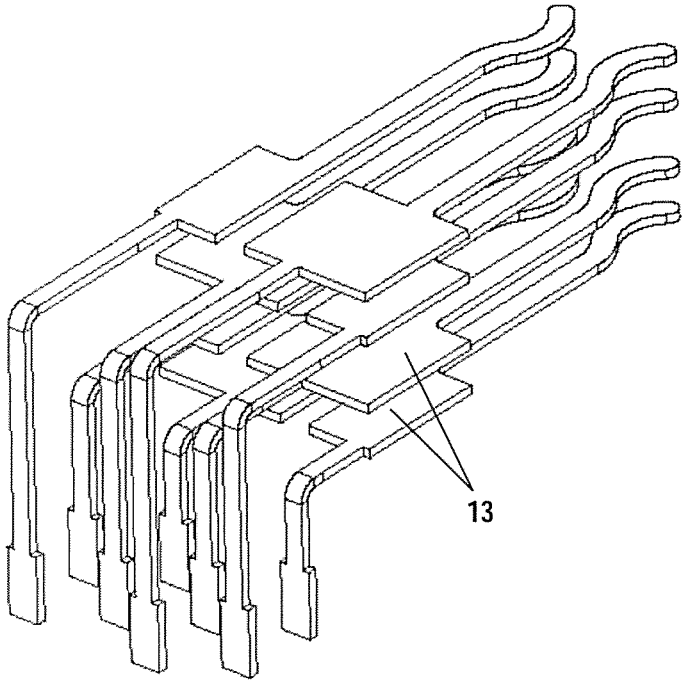
FIG. 11 is a perspective view of the conductive terminal assembly.

Although electrical balance, as described in the above embodiments of FIGS. 2-7, achieved through widening and offsetting the terminals, one of ordinary skill in the art would appreciate that if the space available is large enough, the undesired single-end coupling may be reduced, and thereby the differential crosstalk may be reduced, only by directly offsetting terminals that need an increase the single-end coupling. If the space available is relatively small, but not as small as the space described in the above embodiments, only the terminal bodies 13 are widened for terminals that need an increase the single-end coupling, without simultaneously offsetting terminals which do not need an increase the single-end coupling (see FIG. 11), because the alignment area of these terminals is within a controllable scope since the available space is sufficient. Such changes are permitted within the scope of the invention, so long as the changes can still meet the requirements of CAT 5e.

By improving the structure and/or arrangement of conductive terminal assemblies 10 in an electrical connector, the present invention enhances desired single-end coupling between terminals and/or reduce undesired single-end coupling between terminals to make the differential signal terminal pairs electrically more "balanced". Differential crosstalk introduced at a mating plug connector and in a mating area of the plug connector and the receptacle connector is counteracted without changing the structure of the mating plug connector and the mating area of terminals of the electrical connector. Additionally, the small form factor of the electrical connector is maintained.

One of ordinary skill in the art would appreciate that variations and improvements to the above shapes and arrangements may be made, including combinations of technical features revealed or protected individually here, and including other combinations of these features. These variations and/or combinations all fall within the technical field to which the present invention relates and fall within the protection scope of claims of the present invention. Any reference sign in claims shall not be construed as limiting the scope of the present invention.

What is claimed is:

1. A conductive terminal assembly of an electrical connector, comprising:

a terminal alignment plate made of a dielectric material; and four pairs of differential signal terminals arranged in two columns in an array on the terminal alignment plate, each terminal having a terminating end, a contacting end arranged in one of the two columns, and a terminal body extending between the terminating end and the contacting end;

wherein adjacent terminal bodies of the four pairs of differential signal terminals arranged in one of the two columns are transversely offset from each other and one of the adjacent terminal bodies is wider than the other of the adjacent terminal bodies.

2. The conductive terminal assembly of claim 1, wherein the adjacent terminal bodies positioned in the one of the two columns do not overlap.

3. The conductive terminal assembly of claim 2, wherein lengths of the terminating end of adjacent terminal bodies positioned in the one of the two columns are different from eachother.

4. A conductive terminal assembly of an electrical connector, comprising:

a terminal alignment plate; and four pairs of differential signal terminals arranged in two columns in an array on the terminal alignment plate, each terminal having a terminating end, a contacting end positioned in one of the two columns of the array, and a terminal body extending between the terminating end and the contacting end;

wherein lengths of the terminating end of adjacent terminal bodies positioned in the one of the two columns are different from each other.

5. An electrical connector comprising:

an insulating body; and two conductive terminal assemblies positioned in the insulating body, each assembly having:

a terminal alignment plate made of a dielectric material;

four pairs of differential signal terminals arranged in two columns in an array on the terminal alignment plate, each terminal having a terminating end, a contacting end, and a terminal body extending between the terminating end and the contacting end with the terminal bodies of two adjacent first terminals in the same column being offset transversely.

* * * * *